US005878450A

United States Patent [19]

Bouhuijs

[11] Patent Number: 5,878,450

[45] Date of Patent: Mar. 9, 1999

[54] DEVICE AND METHOD FOR RAISING OR MOVING A PERSON

[75] Inventor: Menno Cornelis Bouhuijs, Hengelo, Netherlands

[73] Assignee: Careflex Holding B.V., Netherlands

[21] Appl. No.: 913,126

[22] PCT Filed: Mar. 11, 1996

[86] PCT No.: PCT/NL96/00109

§ 371 Date: Sep. 9, 1997

§ 102(e) Date: Sep. 9, 1997

[87] PCT Pub. No.: WO96/28125

PCT Pub. Date: Sep. 19, 1996

[30] Foreign Application Priority Data

Mar. 10, 1995 [NL] Netherlands ..... 9500482

[51] Int. Cl.[6] ..... A61G 7/10; A61G 7/12

[52] U.S. Cl. ..... 5/86.1; 5/83.1

[58] Field of Search ..... 5/86.1, 83.1, 81.1 R, 5/89.1

[56] References Cited

U.S. PATENT DOCUMENTS

| | | | |
|---|---|---|---|
| 2,747,652 | 5/1956 | Marsh . | |
| 3,189,345 | 6/1965 | Simpson | 272/70.4 |
| 3,277,502 | 10/1966 | Wauthier | 5/81.1 R |
| 3,623,169 | 11/1971 | James | 5/81.1 R |
| 3,629,380 | 12/1971 | Van Rhyn | 5/86.1 |
| 3,996,632 | 12/1976 | Bakker nee Viel | 5/83.1 |
| 4,028,752 | 6/1977 | Oerthel | 5/86.1 R |
| 4,682,377 | 7/1987 | Reich | 5/86.1 |
| 4,703,523 | 11/1987 | James | 5/83.1 |
| 4,712,257 | 12/1987 | James | 5/83.1 |
| 4,837,874 | 6/1989 | Giercarz et al. | 5/83.1 |
| 4,918,771 | 4/1990 | James | 5/86.1 |
| 5,001,789 | 3/1991 | Schoenberger | 5/86.1 |
| 5,022,106 | 6/1991 | Richards | 5/86.1 |
| 5,117,516 | 6/1992 | Penner | 5/86.1 |
| 5,309,584 | 5/1994 | Parker | 5/86.1 |
| 5,365,621 | 11/1994 | Blain | 5/86.1 |
| 5,459,891 | 10/1995 | Reeve et al. | 5/87.1 |
| 5,644,805 | 7/1997 | Horcher | 5/86.1 |

FOREIGN PATENT DOCUMENTS

| | | |
|---|---|---|
| 0 547 901 A1 | 6/1993 | European Pat. Off. . |
| 2140773 | 12/1984 | United Kingdom . |

*Primary Examiner*—Alex Grosz

*Attorney, Agent, or Firm*—Joseph P. Gastel; Elliott I. Pollock

[57] ABSTRACT

A device for moving a person to and from a seated position including a frame, an auxiliary arm having first and second ends and extending laterally outwardly from the frame, a first pivotal connection between the frame and the first end of the auxiliary arm, a lifting arm having first and second ends, a second pivotal connection between the first end of the lifting arm and the second end of the auxiliary arm, a first motor connected between the frame and the auxiliary arm, and a second motor connected to the lifting arm. A method of moving a person to a standing position from a seated position on a seat including the steps of providing an attachment member for engagement with the person, moving the person who is connected to the attachment member slightly upwardly and thereafter in an essentially horizontal direction, and thereafter moving the person in an essentially vertical direction to a standing position, returning the person from a standing position to the seated position by moving the person essentially horizontally to above the seat, and then moving the person essentially vertically onto the seat.

24 Claims, 4 Drawing Sheets

4
6
9
5
17
14
11
2
10

DEVICE AND METHOD FOR RAISING OR MOVING A PERSON

The present invention relates to a device according to the preamble of claim 1.

Such a device is disclosed in GB-A-2,140,773. In this patent specification the position of the lifting arm can be changed with regard to the position of the auxiliary arm by a manually operated cam meganism. In this way the lifting arm can be adapted to the position of the person to be lifted. The lifting arm assembly is hingeably mounted on en essentially vertical frame. With this arrangement it is essential that the length of the lifting arm corresponds to the length of the femur of the person concerned. By turning the lifting arm assembly with respect to the frame, the person can be raised. With this arrangement it is assumed that a sort of parallelogram construction is produced, two sides of the parallelogram being formed by, on one side, the lifting arm and, on the other side, the femur of the patient.

It has been found that a lifting movement of this type is unnatural, offers no possibilities for providing adjustment to suit persons who still have some strength to stand up on their own and is unsuitable for rehabilitation purpose. Moreover, problems arise with people of different heights.

The aim of the present invention is to provide a device which does not have these disadvantages.

This aim is realized with the device as described above having the characterizing features of claim 1.

The invention is based on the insight of replacing the lifting arm assembly by an articulated construction consisting of the lifting arm and an auxiliary arm connected thereto. The auxiliary arm, in turn, is connected to the frame. In this way it is possible to execute a large number of different movements at the ends of the lifting arm, which is gripped by the patient. Such gripping can take place either by attachment means such as grab bars or a strap which is fastened to the ends of the lifting arm, or by both said means.

As a result of the articulated construction it is, for example, possible when raising a person from a seated position first to let said person move essentially forwards towards the device and then move essentially upwards, that is to say in the vertical direction.

This is in contrast to the device according to the above-mentioned British Application GB-2,110,773, in which the first part of the movement will always be essentially vertical or, in an extreme case, horizontal in the direction away from the device.

The movement which is possible using the device according to the invention is much more natural and stimulates the person concerned to cooperate in being raised, so that his or her muscle function is maintained and/or trained as far as possible.

Moreover, this construction offers the possibility of following a different path when moving from the standing position into the seated position. In such a case it is possible for the patient first to be moved from the standing position horizontally to above the seat and then be moved vertically.

It must be understood that numerous other seated/standing/seated paths are also possible with the construction according to the invention.

The means for controlling the movement of the lifting arm from the frame preferably comprise a rod transmission. Because said rod transmission will in practice largely be under tensile stress, a more flexible transmission is likewise possible. Preferably, a safety device is fitted to prevent the person from being trapped between the arm and his or her chair.

If a rod transmission is used, two rods hingeably connected to one another are preferably fitted, one of said rods being pivotably mounted in the hinge point of the auxiliary arm in the frame. In this way the force needed to move the lifting arm essentially bypasses the auxiliary arm. Consequently, independent movement of auxiliary arm and lifting arm is relatively simple to achieve because movement of the one arm has no effect on the operating force on the other arm.

The arms can be controlled by operating elements such as motors. The motors are preferably of such construction that the movement generated by the motors is actually recorded. The various features can be controlled via a central control unit, such as a programmable logic controller, also known as a PLC. With a control of this type it is possible to incorporate various paths. It is also possible to vary the force with which the motors are operated. After all, for rehabilitation purposes it is important that the seated person is trained to use at least some of his or her own strength to stand up. By designing the various features in such a way that the lifting force is limited, such a person is stimulated to use his or her own strength. Moreover, it is possible to allow the motors to operate at various speeds, optionally depending on the response from the person concerned.

A further possibility which may be mentioned is design of the control unit in such a way that the control starts the begin of the movement path at the point in time when the motors are subjected to a resisting force, that is to say at the point in time at which the device has "taken up the strain". That is to say an accurately defined lifting path is always executed from the start of lifting irrespective of the position of the seated person with respect to the lifting device.

Preferably, knee supports are provided, against which the person can support him- or herself while being raised. Preferably, these supports are mounted such that they are flexible with respect to the frame.

According to a further advantageous embodiment, the device according to the present invention is provided with read-out means. This enables the activities carried out by the device to be read out at a central location. This can take place with the aid of a connector or can also be effected by cordless means. The device can furthermore be provided with means for patient-specific read-out of the activities executed by the device.

The invention also relates to a method according to claim 11. Preferable embodiments are described in claims 12 and 13. From the European patent application 0,547,901 a lifting arm is known hingedly or pivotally connected to a frame wherein at a free extremety of the lifting arm fixings for a support belt are provided. At a raising of the lifting arm this free extremety described a circle such that the patient is both lifted in upward direction and in a direction to the frame.

The invention will be explained in more detail below with reference to an illustrative embodiment of the invention shown in the drawings. In the drawings.

Figure 1:
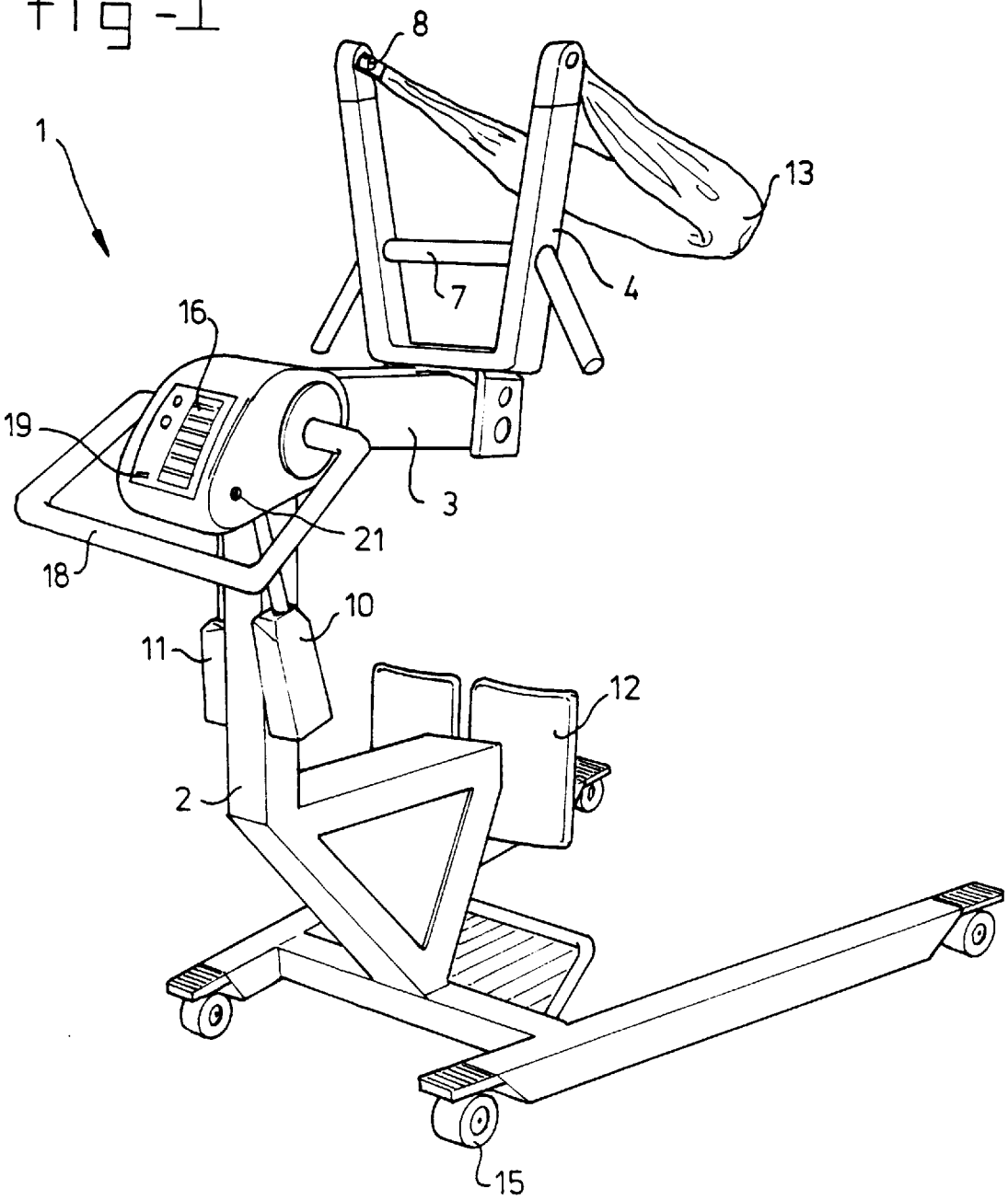
FIG. 1 shows a perspective view of the device according to the invention.
Figure 4:
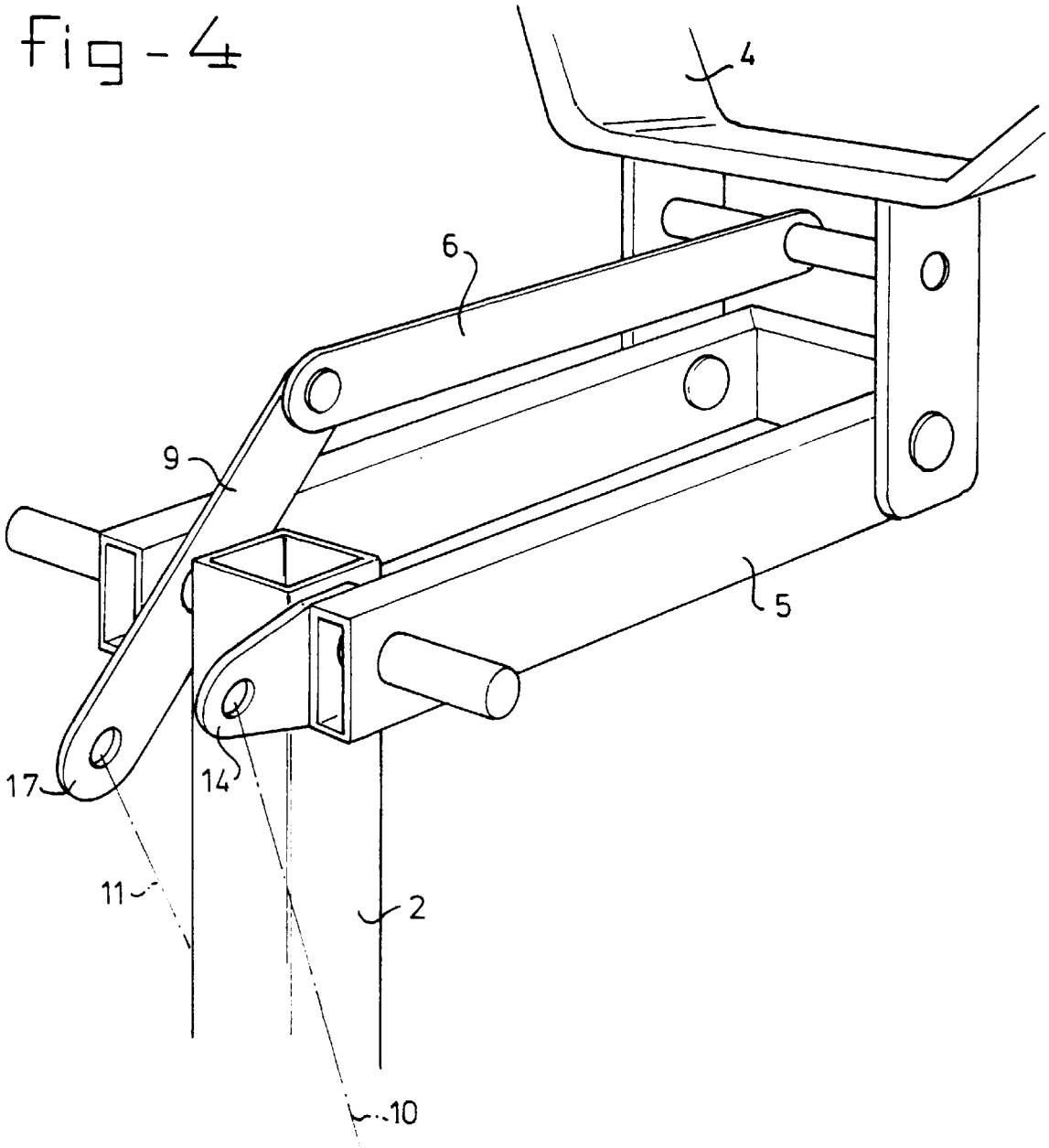
FIG. 4 shows a detail of the lifting arm/auxiliary arm assembly.

In FIG. 1 the device according to the invention is indicated in its entirety by 1. This device consists of a frame 2, which is moved on castors 15. That part of frame 2 which extends vertically is constructed such that it is offset somewhat to the left in connection with the presence of auxiliary arm 5. This auxiliary arm 5 is shown in more detail in FIG. 4. Only cover 3, which covers both auxiliary arm 5 and rod 6, is visible in FIG. 1. Comparison of FIGS. 1 and 4 shows that this auxiliary arm 5 is hingeably or pivotally attached to frame 2. Lifting arm 4 is hingeably or pivotally attached to the other free end of auxiliary arm 5. Lifting arm 4 is likewise hingeably or pivotally connected to rod 6. It can be seen from FIG. 1 that the lifting arm 4 is provided with grab bars 7 as well as fixings 8 for a support belt 13, which is indicated diagrammatically. This support belt 13 can be unhooked from the fixings 8.

The other, free end of rod 6 is hingeably or pivotally connected to rod 9. This rod 9 pivots about a hinge or pivot which is coincident with the hinge or pivot for auxiliary arm 5 with frame 2. The free end of auxiliary arm 5, which is indicated by 14, and the free end of rod 9, which is indicated by 17, are connected to a motor 10 and 11 respectively, as can be seen from FIG. 1. It can also be seen from FIG. 1 that a pull bar 18 is provided, as well as a console 19 in which various control instruments are housed. There is a control unit 16 inside console 19. Display means can also be provided on console 19.

A set of knee supports 12 is also mounted on frame 2. These knee supports are fixed such that they are flexible with respect to the frame, for example by fixing blocks of flexible material, such as rubber blocks, between knee supports and frame. These blocks are indicated diagrammatically by 20 in FIG. 2.

By controlling the motors 10 and 11 it is possible to move auxiliary arm 5 and lifting arm 4 independently of one another. Moreover, the construction of the rod transmission 6, 9 ensures that the force which acts on lifting arm 4 is essentially taken up by motor 11, so that motor 10 only has to have a rating which is appropriate for moving auxiliary arm 5 and that motors 10 and 11 are subjected to approximately equal loads.

The position of the auxiliary arm and lifting arm can be determined with the aid of counter devices fitted in the motors 10 and 11, which counter devices record the number of revolutions. These motors can be, for example, electric motors powered by a battery, which is not shown in more detail, these motors operating the relevant arms with the aid of a worm/nut mechanism. A read-out connector is indicated by 21.

An example of raising a patient from a seated position, shown in FIG. 2, into a standing position, shown in FIG. 3, will be given below.

Figure 2:
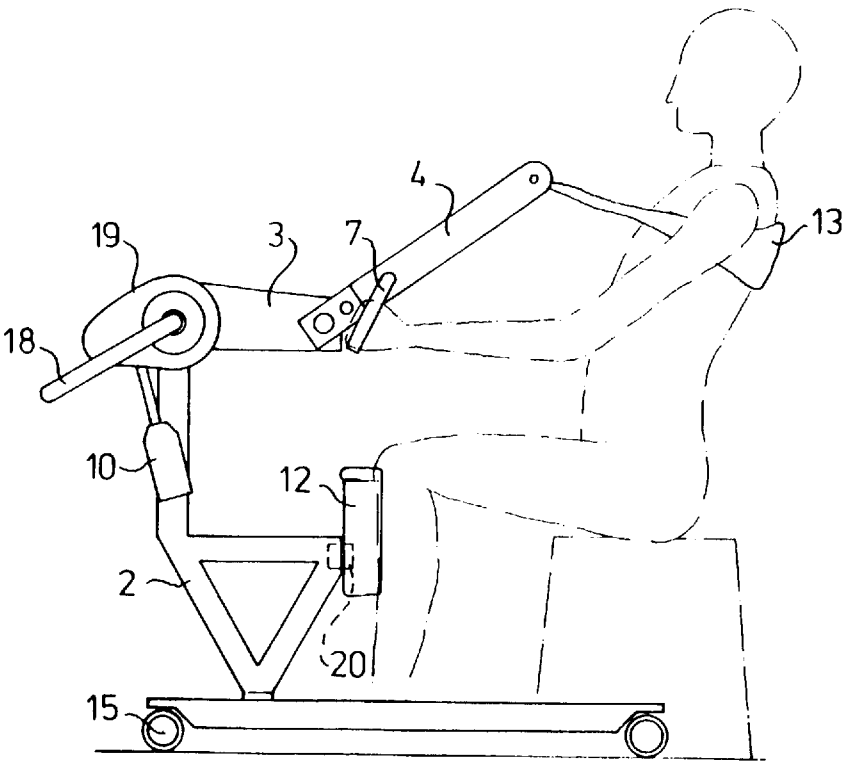
FIG. 2 shows a side view of the device in use with a seated person.

Starting from the situation shown in FIG. 2, lifting arm 4 will be pivoted to the left by means of motor 11 until motor 11 is subjected to a reaction force due to the weight or the seated person. At that point in time the controller will be set to the 0 position and the program for the specific movement path will be started. This movement path can be determined on console 19. It is also possible to fit a remote control. Starting from the "strain taken up" position shown in FIG. 2, the seated person will be moved slightly upwards and moved towards the device in an essentially horizontal direction by further pivoting of the lifting arm 4, possibly corrected by a movement of auxiliary arm 5.

Depending on the condition of the person concerned, the horizontal forward movement will be continued. If the related person no longer has any muscle strength at all, the forward movement will be less pronounced than in the case of persons who have some residual strength. Following said horizontal movement, the person will be moved upwards by interaction of auxiliary arm and lifting arm until the person ultimately assumes the position shown in FIG. 3.

When sitting down again, the person concerned will first be moved horizontally in the direction away from the machine and then subjected to a lowering movement, in contrast to the movement described above.

This procedure prevents the knees of the person concerned from "locking up" when sitting down.

Using the device according to the invention it is possible to carry out lifting at different speeds.

During this movement the person can be supported by the support belt and/or hold onto grab bars 7.

Figure 3:
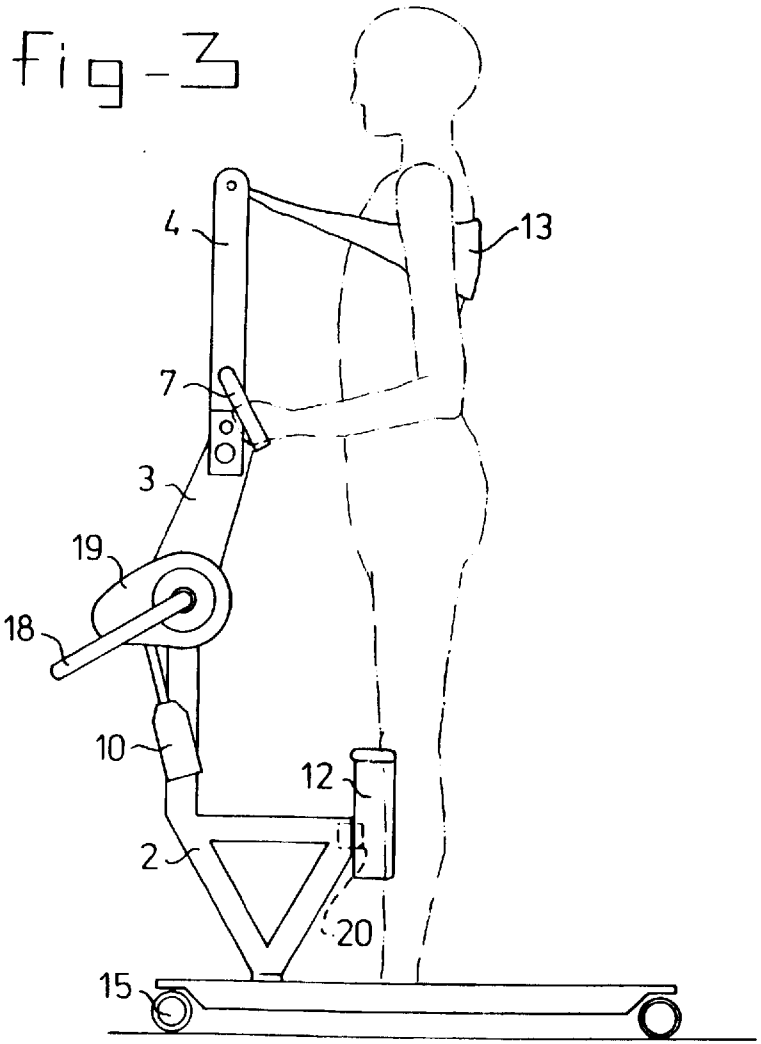
FIG. 3 shows a side view of the device with the person in the standing position.
Figure 5:
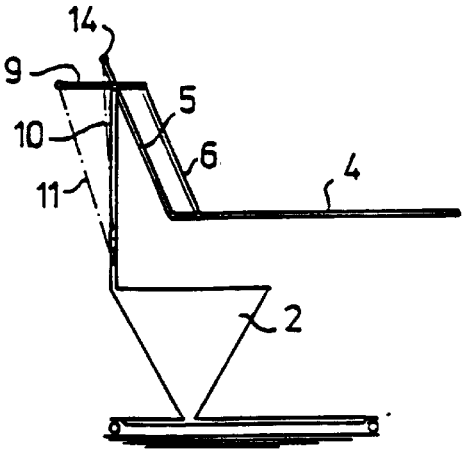
FIGS. 5–7 show, diagrammatically, various positions of lifting arm/auxiliary arm and rod transmission.
Figure 6:
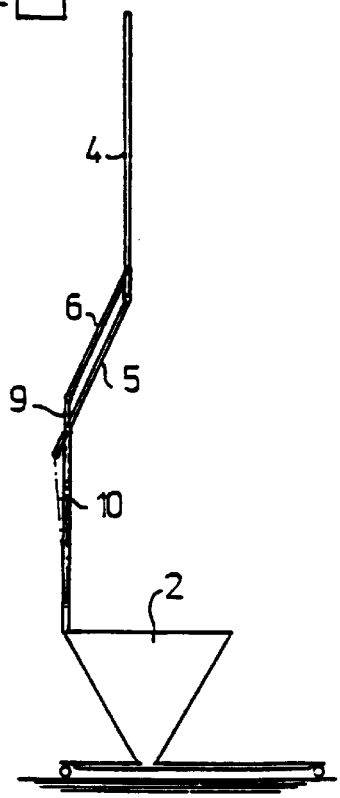
Figure 7:
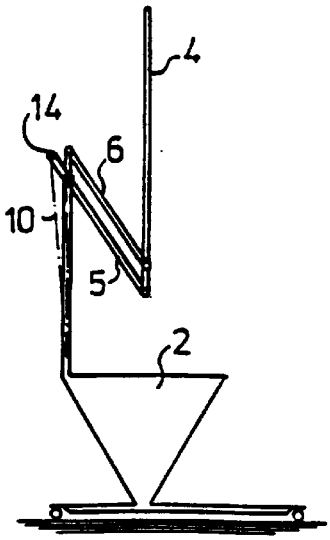

FIGS. 5–7 show the device in various positions corresponding to FIGS. 2 and 3 and a storage position.

It can be seen from the above that it is possible, using the device described above, to match the pattern of movement to the individual using the device.

Furthermore, it is possible to provide the device with a memory in which the operations carried out therewith can be saved. A memory of this type can be made patient-dependent. By providing a connection to a central computer, which, for example, comprises the read-out connector 21, it is possible to establish from a central location by whom and to what extent use has been made of the device concerned. If, for example, the device is used in a toilet, it is possible to establish how frequently which persons have made use of that toilet. It is also possible to establish how often the device described above is used.

If the data read out are patient-dependent, it is possible to establish whether a patient is making more or less use of the device. This can indicate an improvement or a deterioration in condition. In this way a more objective determination of the state of health of the patient can be obtained than is possible on the basis of different assessments by various members of the nursing staff.

Of course, it is also possible using this type of read-out to establish the extent to which the device has been subject to malfunctions and the like.

It must be understood that a read-out of this type, especially where this is carried out with the aim of patient-specific read-out relating to the use of the device according to the invention, can also be employed with other raising lifts or equipment used in the medical world.

Although the invention has been described above with reference to a preferred embodiment, it will be understood that numerous modifications can be made thereto which are obvious variants of the principle of the invention. This principle is described in the appended claims and comprises an articulated construction of the lifting arm/auxiliary arm, as a result of which it is no longer necessary to maintain the purely circular movement according to the prior art.

I claim:

1. A device for moving a person to and from a seated position comprising a frame, an auxiliary arm having first and second ends and extending laterally outwardly from said frame, a first pivotal connection between said frame and said first end of said auxiliary arm, a lifting arm having first and second ends, a second pivotal connection between said first end of said lifting arm and said second end of said auxiliary arm, a first motor connected between said frame and said auxiliary arm, and a second motor connected to said lifting arm.

2. A device as set forth in claim 1 including a linkage between said second motor and said lifting arm.

3. A device as set forth in claim 2 wherein said second motor is mounted on said frame.

4. A device as set forth in claim 3 wherein said linkage comprises a first link having a first link end and a second link end, a second link having a third link end and a fourth link end, a third pivotal connection between said first link end and said lifting arm, a fourth pivotal connection between said second link end and said third link end, and a connection between said second motor and said fourth link end.

5. A device as set forth in claim 4 including a fifth pivotal connection between said second link and said frame.

6. A device as set forth in claim 5 wherein said fifth pivotal connection is located between said third and fourth link ends.

7. A device as set forth in claim 6 wherein said first pivotal connection and said fifth pivotal connection are located on substantially the same horizontal axis.

8. A device as set forth in claim 7 wherein said third pivotal connection is located between said first and second ends of said lifting arm.

9. A device as set forth in claim 1 including a programmable logic controller coupled to said first and second motors.

10. A device as set forth in claim 9 including a linkage between said second motor and said lifting arm.

11. A device as set forth in claim 10 wherein said second motor is mounted on said frame.

12. A device as set forth in claim 11 wherein said linkage comprises a first link having a first link end and a second link end, a second link having a third link end and a fourth link end, a third pivotal connection between said first link end and said lifting arm, a fourth pivotal connection between said second link end and said third link end, and a connection between said second motor and said fourth link end.

13. A device as set forth in claim 12 including a fifth pivotal connection between said second link and said frame.

14. A device as set forth in claim 13 wherein said fifth pivotal connection is located between said third and fourth link ends.

15. A device as set forth in claim 14 wherein said first pivotal connection and said fifth pivotal connection are located on substantially the same horizontal axis.

16. A device as set forth in claim 15 wherein said third pivotal connection is located between said first and second ends of said lifting arm.

17. A device as set forth in claim 1 including knee supports on said frame.

18. A device as set forth in claim 17 including castors on said frame.

19. A device for moving a person to and from a seated position comprising a frame, an auxiliary arm having first and second ends and extending laterally outwardly from said frame, a first pivotal connection between said frame and said first end of said auxiliary arm, a lifting arm having first and second ends, a second pivotal connection between said first end of said lifting arm and said second end of said auxiliary arm, and motor means coupled to said auxiliary arm and said lifting arm for pivoting said auxiliary arm and said lifting arm independently of each other.

20. A device as set forth in claim 19 wherein said motor means comprise first and second motors mounted on said frame.

21. A device as set forth in claim 20 including a first linkage between said first motor and said auxiliary arm, and a second linkage between said second motor and said lifting arm.

22. A device as set forth in claim 19 including a programmable logic controller coupled to said motor means.

23. A method for moving a person from a seated to a standing position and vice versa with the use of a lifting device which is arranged on the chest side of a person and which has a frame and an auxiliary arm pivotally mounted on said frame and a lifting arm pivotally mounted on said auxiliary arm and a first motor connected to said auxiliary arm and a second motor connected to said lifting arm, and a support belt attached to the outer end of said lifting arm which is placed around the person's back at armpit height and on which a force is exerted on the person's chest side, comprising the steps of causing said first and second motors to actuate said auxiliary arm and said lifting arm, respectively, to cause said person to be moved slightly upwardly and thereafter in an essentially horizontal direction, and thereafter moving the person in an essentially vertical direction to a standing position.

24. A method as set forth in claim 23 including the steps of returning the person from a standing position to said seated position by moving the person essentially horizontally to above the seat, and then moving the person essentially vertically onto the seat.

* * * * *